US007798369B2

(12) United States Patent
Ophardt

(10) Patent No.: US 7,798,369 B2
(45) Date of Patent: Sep. 21, 2010

(54) REMOVABLE LEVER ASSEMBLY FOR FLUID DISPENSER

(75) Inventor: Heiner Ophardt, Vineland (CA)

(73) Assignee: Gotohti.com Inc., Beamsville, Ontario (CA)

( * ) Notice: Subject to any disclaimer, the term of this patent is extended or adjusted under 35 U.S.C. 154(b) by 360 days.

(21) Appl. No.: 11/976,778

(22) Filed: Oct. 29, 2007

(65) Prior Publication Data

US 2008/0110936 A1 May 15, 2008

(30) Foreign Application Priority Data

Nov. 14, 2006 (CA) ..... 2567912

(51) Int. Cl.
*B65D 88/54* (2006.01)
*B65D 83/00* (2006.01)

(52) U.S. Cl. ..... 222/180; 222/321.8

(58) Field of Classification Search ..... 222/180, 222/181.2, 181.3, 182, 321.9, 321.8, 472, 222/402.15

See application file for complete search history.

(56) References Cited

U.S. PATENT DOCUMENTS 3,023,081 A * 2/1962 Kulifay ..... 423/509
3,045,878 A * 7/1962 Blanford et al. ..... 222/473
3,174,653 A 3/1965 McEachran
3,224,644 A * 12/1965 Davis ..... 222/162
3,605,133 A * 9/1971 Quercia et al. ..... 4/231
4,579,258 A * 4/1986 Brown et al. ..... 222/323
4,789,083 A * 12/1988 Gutierrez ..... 222/108
5,431,309 A 7/1995 Ophardt
5,904,273 A * 5/1999 Aspacher et al. ..... 222/402.15
6,016,938 A * 1/2000 Eichorst ..... 222/402.15
6,318,600 B1 11/2001 Winnett et al.
2006/0113327 A1 6/2006 Walters et al.
2006/0175353 A1 8/2006 Ophardt et al.

FOREIGN PATENT DOCUMENTS

DE 103 16 692 B3 11/2004
EP 1588773 10/2005
GB 2189847 11/1987
GB 2 435 879 12/2007
WO WO 01/47590 A1 7/2001

* cited by examiner

*Primary Examiner*—Kevin P Shaver
*Assistant Examiner*—Stephanie E Tyler
(74) *Attorney, Agent, or Firm*—Riches, McKenzie & Herbert LLP

(57) ABSTRACT

An assembly for mounting of a lever member to a housing in which a stop member which normally limits rotation of the lever member about a fulcrum is movable to a position which permits the lever member to be disengaged from the housing and removed.

20 Claims, 15 Drawing Sheets

REMOVABLE LEVER ASSEMBLY FOR FLUID DISPENSER

SCOPE OF THE INVENTION

This invention relates to a removable lever assembly in which a lever may be mounted to a housing pivotable about a fulcrum against the bias of a spring and removable from the housing for replacement.

BACKGROUND OF THE INVENTION

Fluid dispensers are well known having manual levers for pivoting to dispense fluid. The present inventor has appreciated a disadvantage of previously known fluid dispensers with manual levers that the levers are difficult to replace without significant disassembly of the dispenser.

SUMMARY OF THE INVENTION

To partially overcome these disadvantages of previously known devices, the present invention provides an assembly for mounting of a lever member to a housing in which a stop member which normally limits rotation of the lever member about a fulcrum is movable to a position which permits the lever member to be disengaged from the housing and removed. The lever is preferably insertable and removable through an access opening to the housing without the need for disassembly of the dispenser.

In one aspect, the present invention provides a removable lever assembly comprising:

a housing having a lever actuator element received thereon for reciprocal movement along a central axis between an extended position and a retracted position, the element having an axially directed lever engaging surface, a spring member biasing the element axially outwardly to the extended position, a lever fulcrum member fixedly secured to the housing spaced from the engaging surface in a rearward direction which extends radially relative to the central axis, a stop member carried on the housing, the stop member movable between the stopping position and an unstopping position, an elongate lever extending about a longitudinal from a rear, first end to a front second end, a housing longitudinal locating member on the housing and a complementary lever longitudinal locating member on the lever member for inter-engagement to limit movement of the lever member relative the housing longitudinally along the longitudinal of the lever member, the longitudinal lever locating member being removable from engagement with the housing longitudinal locating member by relative movement of the lever member relative to the housing generally in the direction of the central axis, wherein in an operative condition with: (a) the lever member located relative the housing to extend about its longitudinal in the rearward direction with the first end rearward of the lever engaging surface in the rearward direction and the second end forward of the lever engaging surface, (b) the lever engaging surface in engagement with the lever member at an engagement location on the lever member intermediate the first end and the second end of the lever member and forward of the fulcrum member biasing the lever member into the fulcrum member to pivot the lever member about the fulcrum member in a first rotational direction about a fulcrum axis which is normal to the rearward direction, normal to the central axis and normal to the longitudinal of the lever member; (c) the housing longitudinal locating member in engagement with the lever longitudinal locating member, and (d) the stop member in the stopping position, then: the lever member is limited in pivoting about the fulcrum axis between; (i) a first position in which rotation in the first rotational direction is limited by the stop member and the element is in the extended position, and (ii) a second position in which rotation in a second rotational direction opposite to the first rotational direction is limited to an inner position in which the element is in the retracted position, wherein from the operative condition on the stop member being moved to the unstopped position, the lever member is movable relative the housing to move the lever longitudinal locating member in a direction of the central axis relative the housing longitudinal locating member to a clear position in which the housing longitudinal locating member and the lever longitudinal locating member are no longer in engagement and the lever member is slidable longitudinally relative the housing for removal from the housing.

Preferably, in accordance with a second aspect, in the first aspect, the stop member is carried on the housing rearward in the rearward direction of the fulcrum member.

Preferably, in accordance with a third aspect, in the second aspect, from the operative condition, if the stop member is moved to the unstopped position to move the lever member to the clear position, then the lever member is moved relative the housing in the direction of the central axis away from the fulcrum member or is pivoted about the fulcrum axis in the first rotational direction past the outer position.

In accordance with a fourth aspect, preferably, in the first aspect, the stop member is carried on the housing forward in the rearward direction of the fulcrum member.

In accordance with a fifth aspect, in the fourth aspect, preferably, from the operative condition, if the stop member is moved to the unstopped position, to move the lever member to the clear position, then the lever member is moved relative the housing in the direction of the central axis away from the fulcrum member or is pivoted about the fulcrum axis in the first rotational direction past the outer position.

In accordance with a sixth aspect, in the first aspect, the housing has a piston chamber forming member fixed thereto, the piston chamber forming member defining a cylindrical chamber about a central axis, the chamber having an open outer end, the lever actuating element comprising a piston forming element coaxially slidably received in the chamber for reciprocal sliding therein between the extended position and the retracted position to dispense fluid, the piston forming element having an inner end within the chamber and an outer end extending out of the open outer end of the chamber and presenting the axially directed engagement surface, and the spring member biasing the piston forming element axially outwardly to the extended position.

In accordance with a seventh aspect, in the sixth aspect, the housing has a piston chamber forming member fixed thereto, the piston chamber forming member defining a cylindrical chamber about a central axis, the chamber having an open outer end, the lever actuating element comprising a piston forming element coaxially slidably received in the chamber for reciprocal sliding therein between the extended position and the retracted position to dispense fluid, the piston forming element having an inner end within the chamber and an outer end extending out of the open outer end of the chamber and presenting the axially directed engagement surface, and the spring member biasing the piston forming element axially outwardly to the extended position.

BRIEF DESCRIPTION OF THE DRAWINGS

Further aspects and advantages of the present invention will become apparent from the following drawings taken together with the claims in which:

DETAILED DESCRIPTION OF THE DRAWINGS

Figure 1:
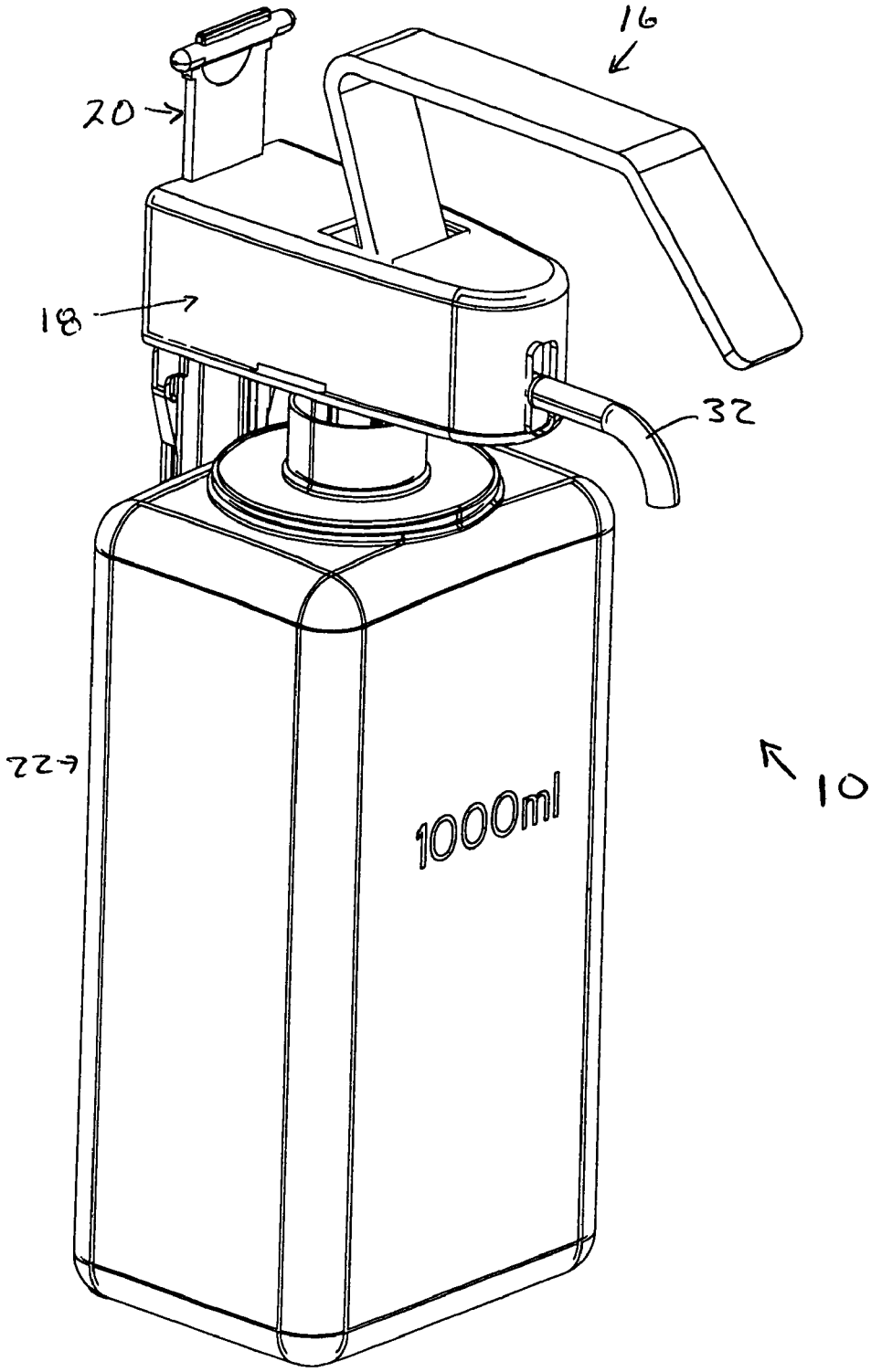
FIG. 1 is a front top perspective view of a dispenser in accordance with a first embodiment of the present invention.
Figure 2:
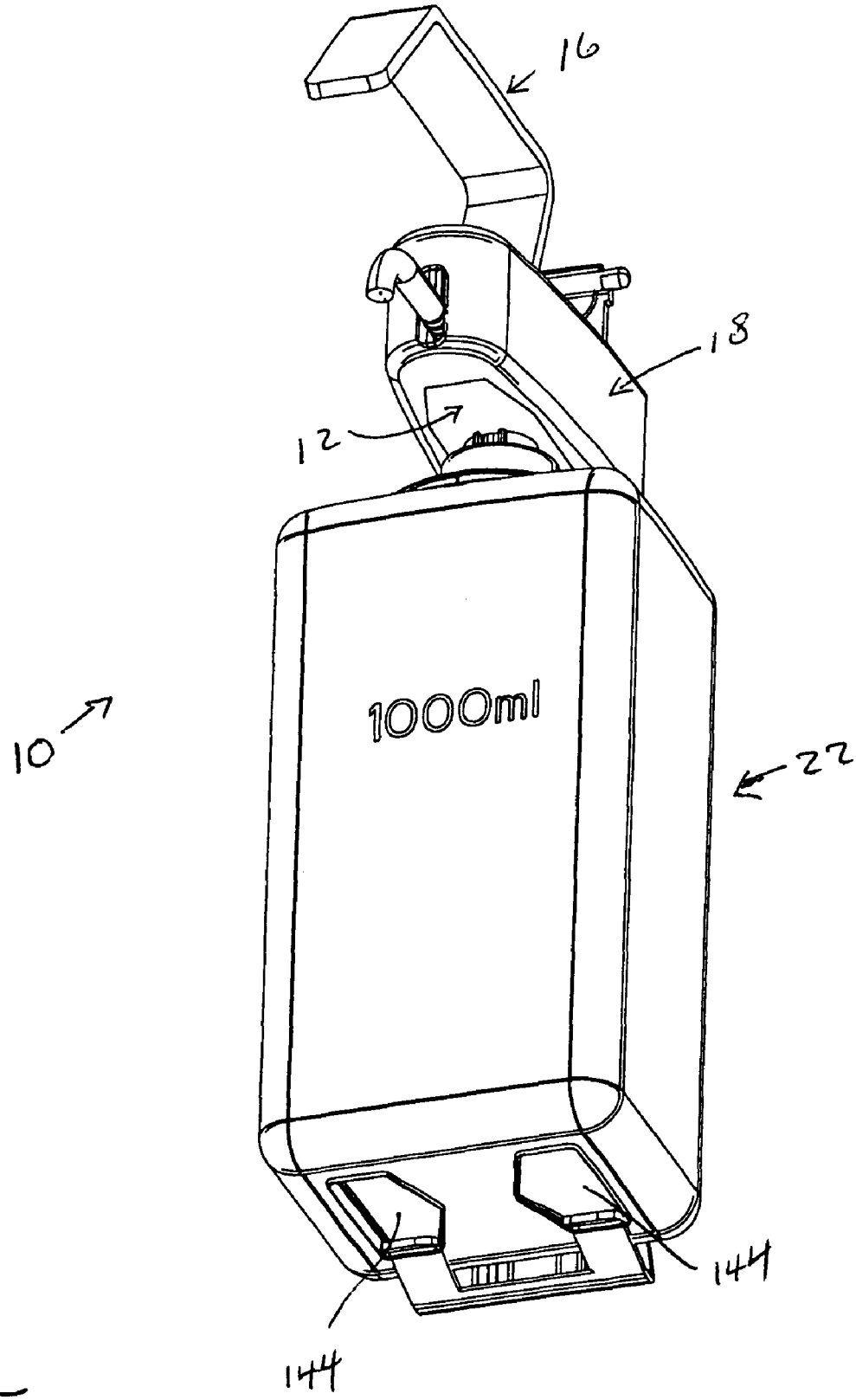
FIG. 2 is a front bottom perspective view of the dispenser of FIG. 1.
Figure 3:
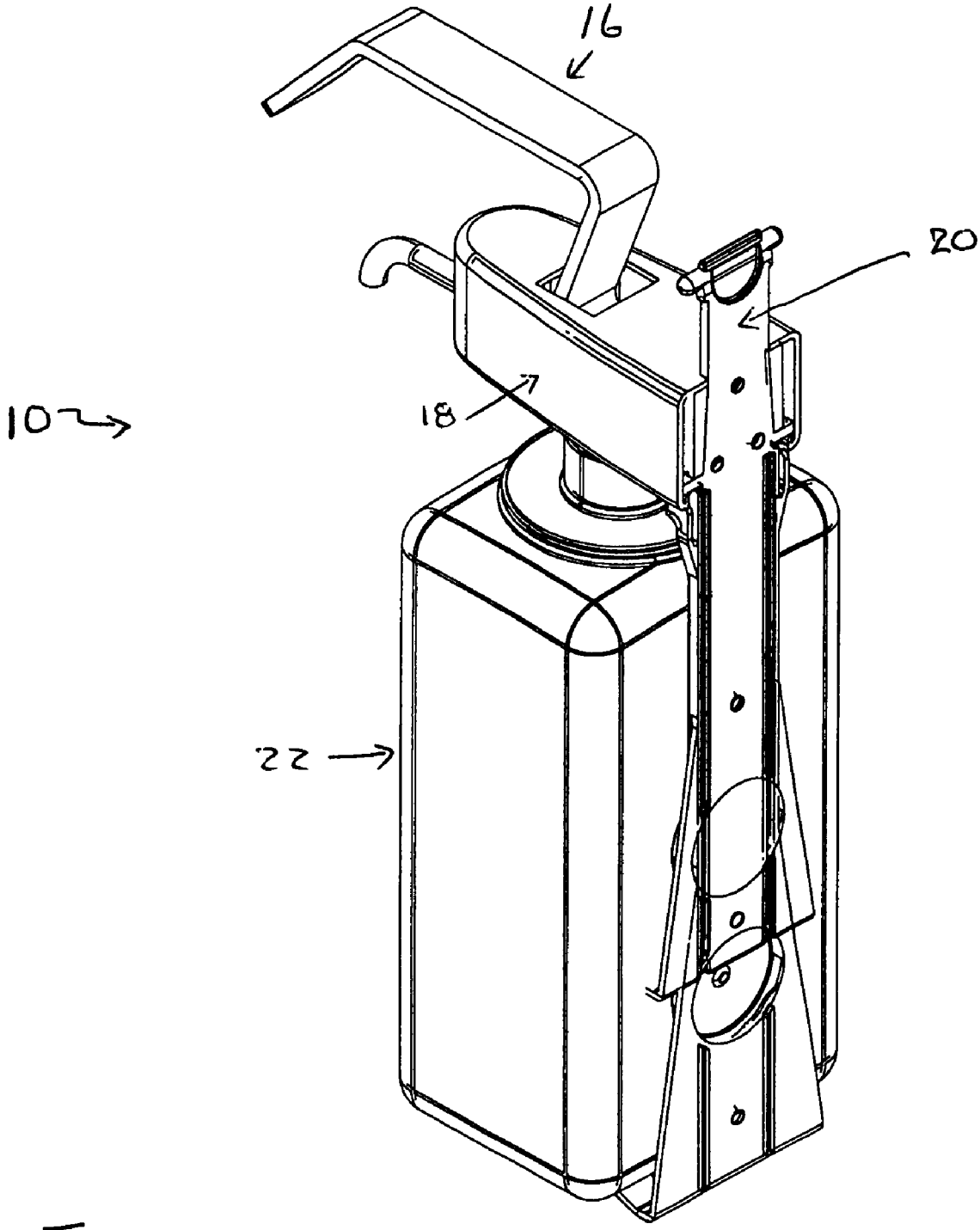
FIG. 3 is a rear top perspective view of the dispenser shown in FIG. 1.

Reference is made to FIGS. 1 to 4 which illustrate a fluid dispenser 10 including a housing 12, a piston element 14, a lever member 16, a cover 18, a back plate 20 and a bottle 22. The back plate 20 is adapted to be secured to a wall. The housing 12 slidably engages on the back plate by being slid rearwardly and then downwardly onto the back plate 20.

Figure 4:
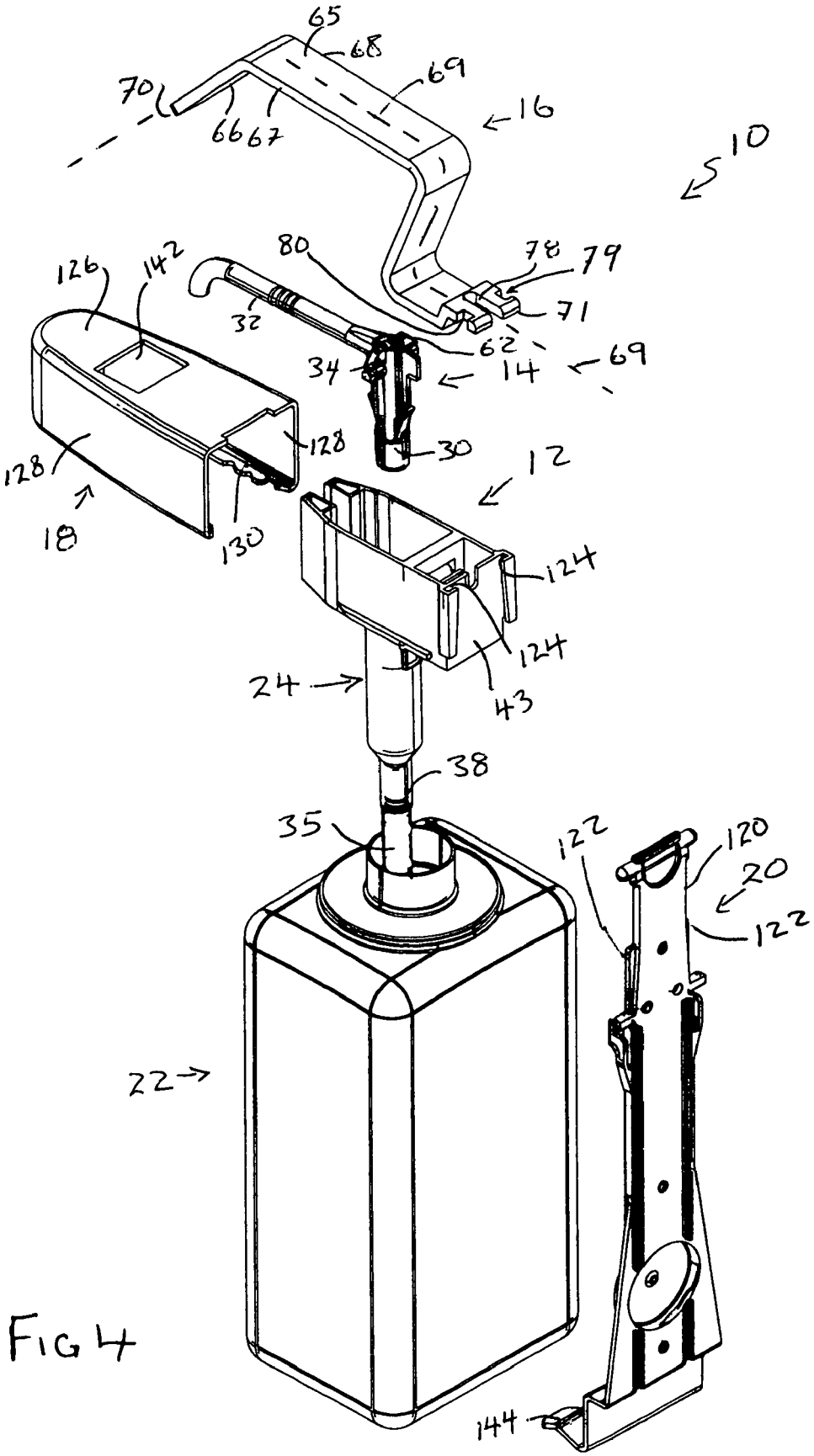
FIG. 4 is a rear top exploded perspective view of the dispenser shown in FIG. 1.
Figure 5:
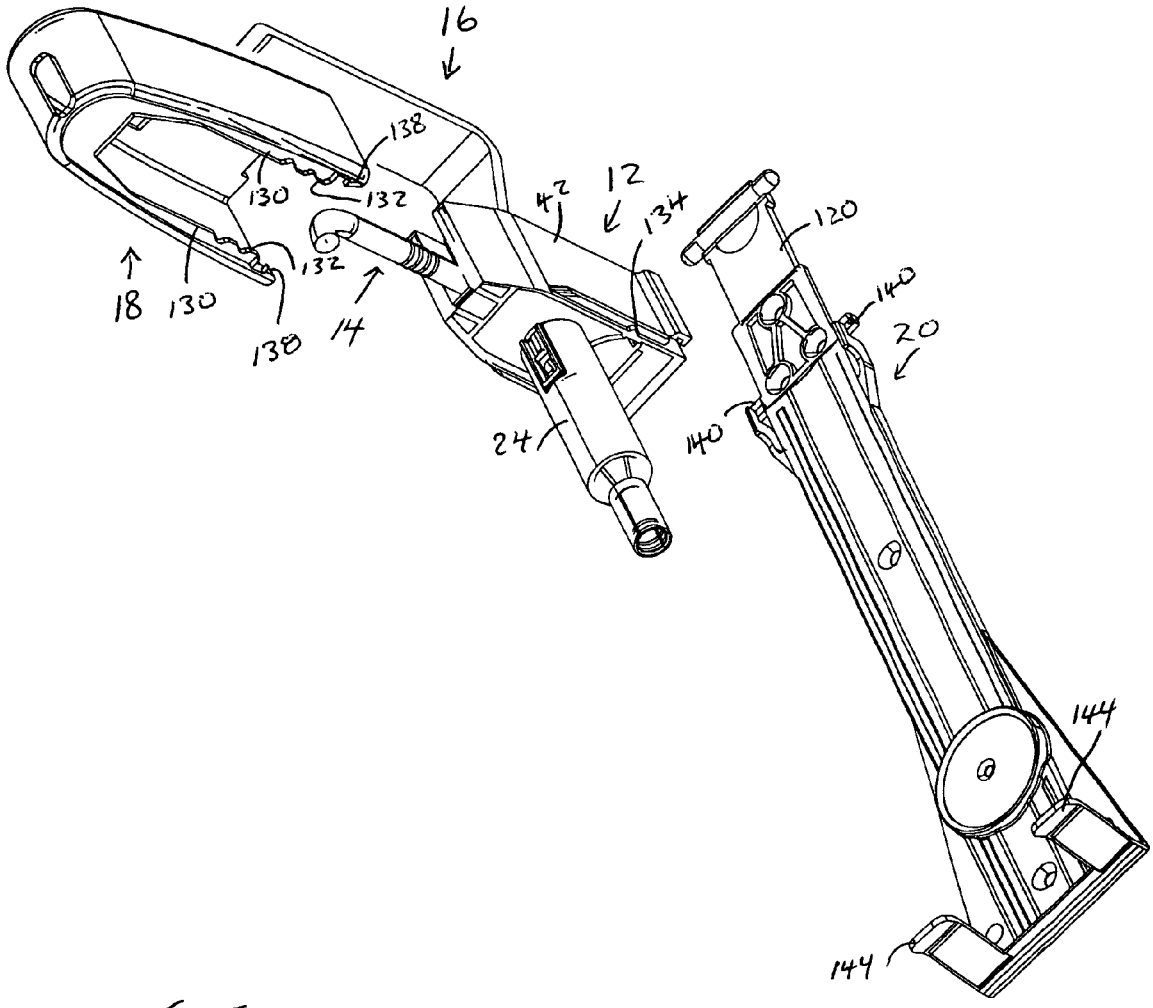
FIG. 5 is a front bottom exploded perspective view showing the cover, the pump mechanism and the back plate of FIG. 4.
Figure 6:
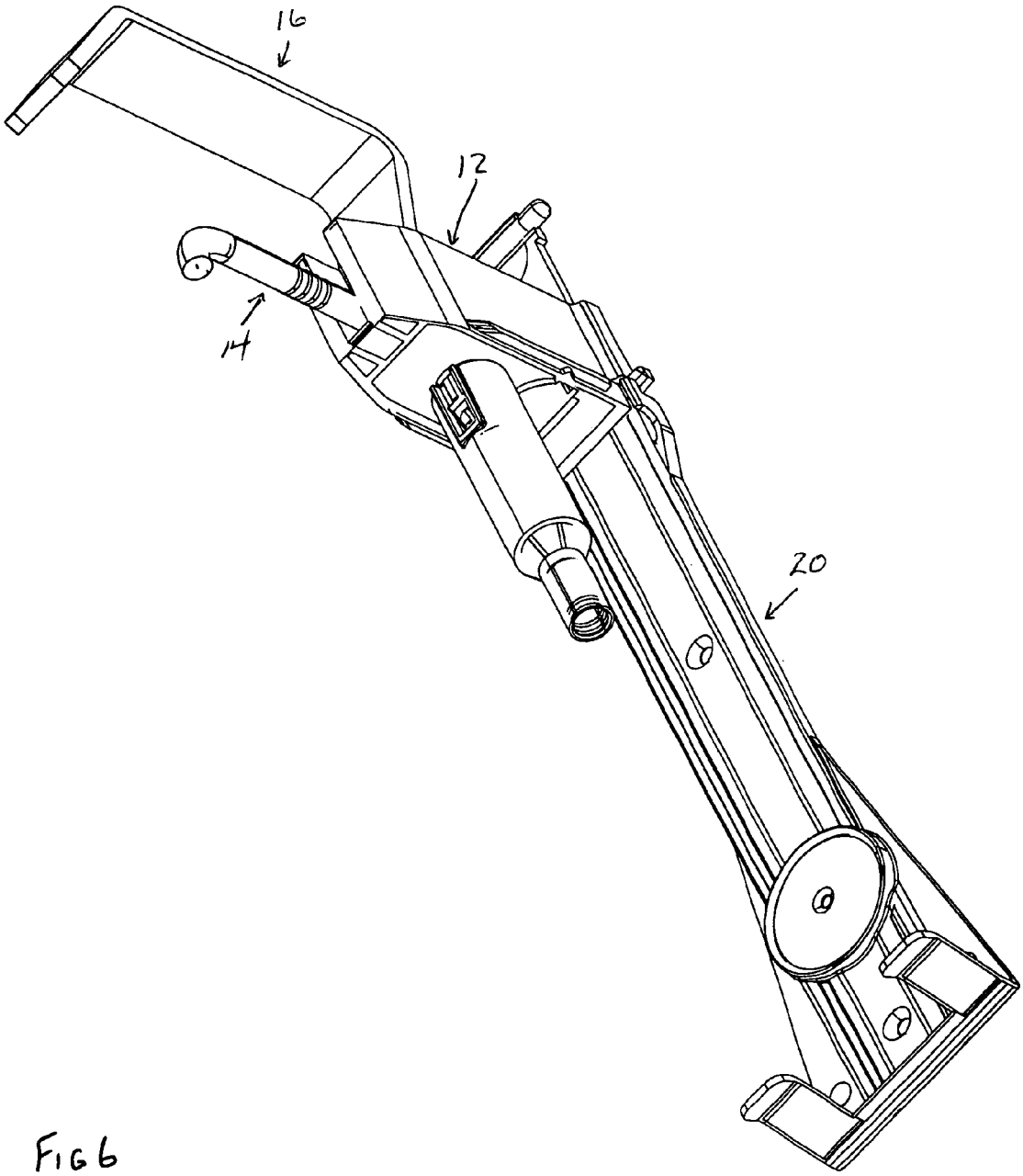
FIG. 6 is a front bottom perspective view similar to that in FIG. 5 showing the pump mechanism coupled to the back plate.
Figure 7:
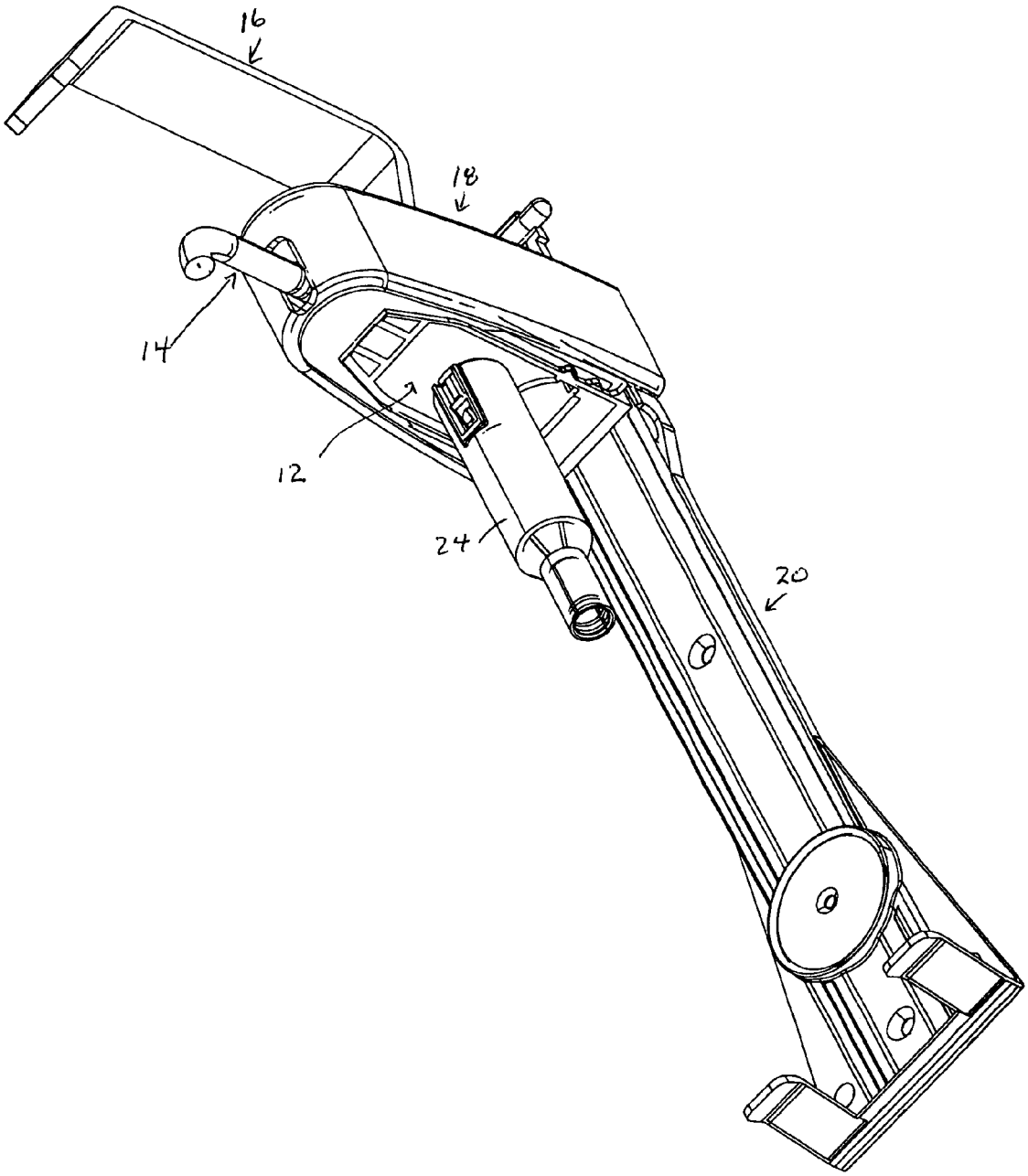
FIG. 7 is a front bottom perspective view similar to FIG. 6 but showing the cover coupled to the pump mechanism and the back plate.
Figure 10:
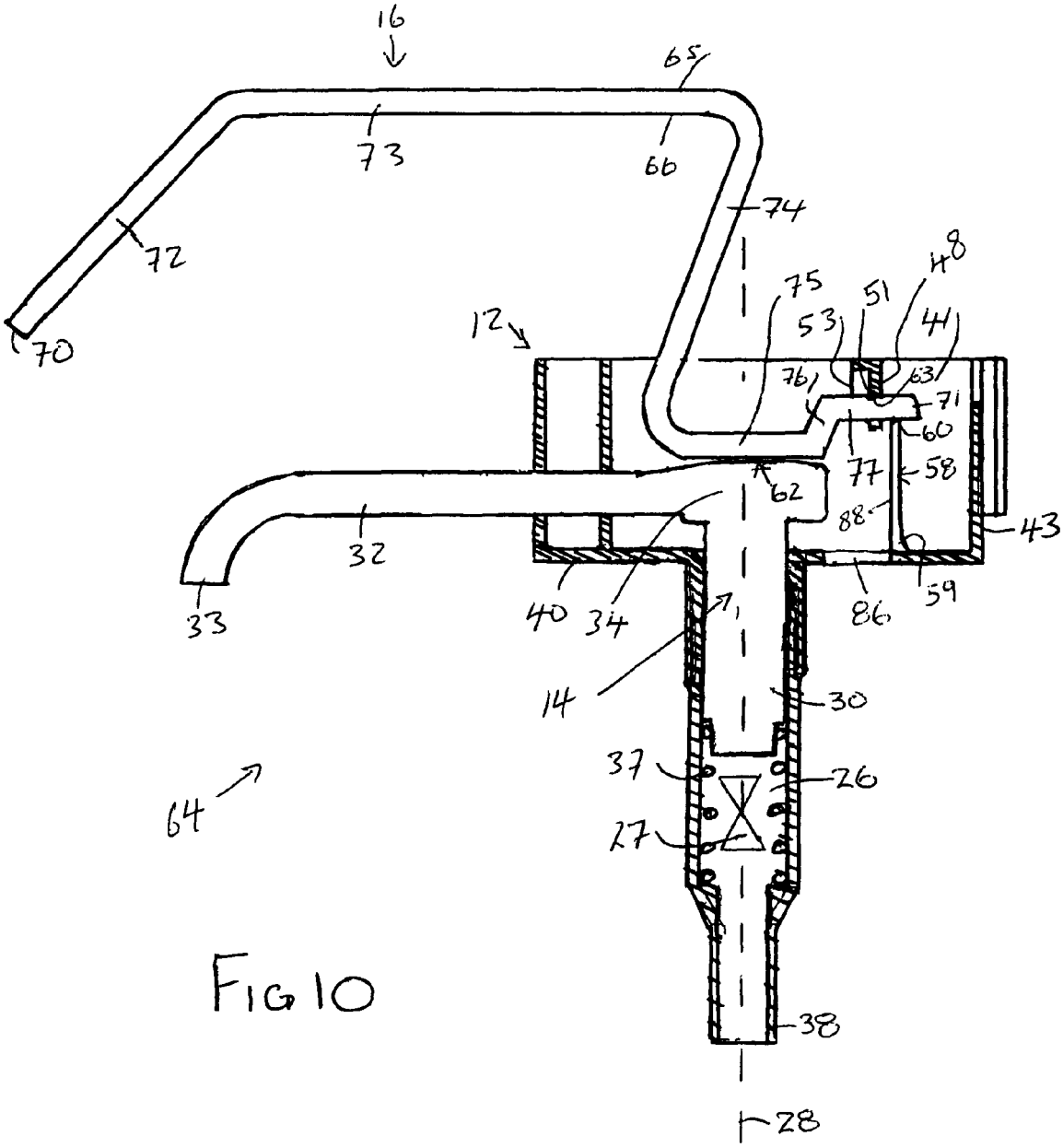
FIG. 10 is a cross-sectional side view through the assembled pump mechanism showing the pump mechanism in an operative condition with the piston element in an extended position.

The housing 12 includes a downwardly extending piston chamber forming member 24 providing a cylindrical chamber 26 therein disposed about a central axis 28 as seen in FIG. 10. The piston element 14 includes an inner piston portion 30 which extends downwardly into the chamber 26 and is coaxially slidable along the central axis 28 to dispense fluid from the bottle out of an elongate hollow forwardly extending nozzle tube 32 carried on an outer piston portion 34 which extends outwardly from an open outer end of the chamber 26. Only FIG. 4 shows a dip tube 35 which extends downwardly from the lower end 38 of the piston chamber forming member 24 into the bottle 22. FIG. 10 schematically shows an arrangement 27 inside the chamber 28 providing for two one-way valves such that with the inner piston portion 30 forming a fluid seal with the chamber 26, reciprocal inward and outward movement of the piston element 14 draws fluid up the dip tube 35 and out of the outlet end 33 of the nozzle tube 32.

Figure 8:
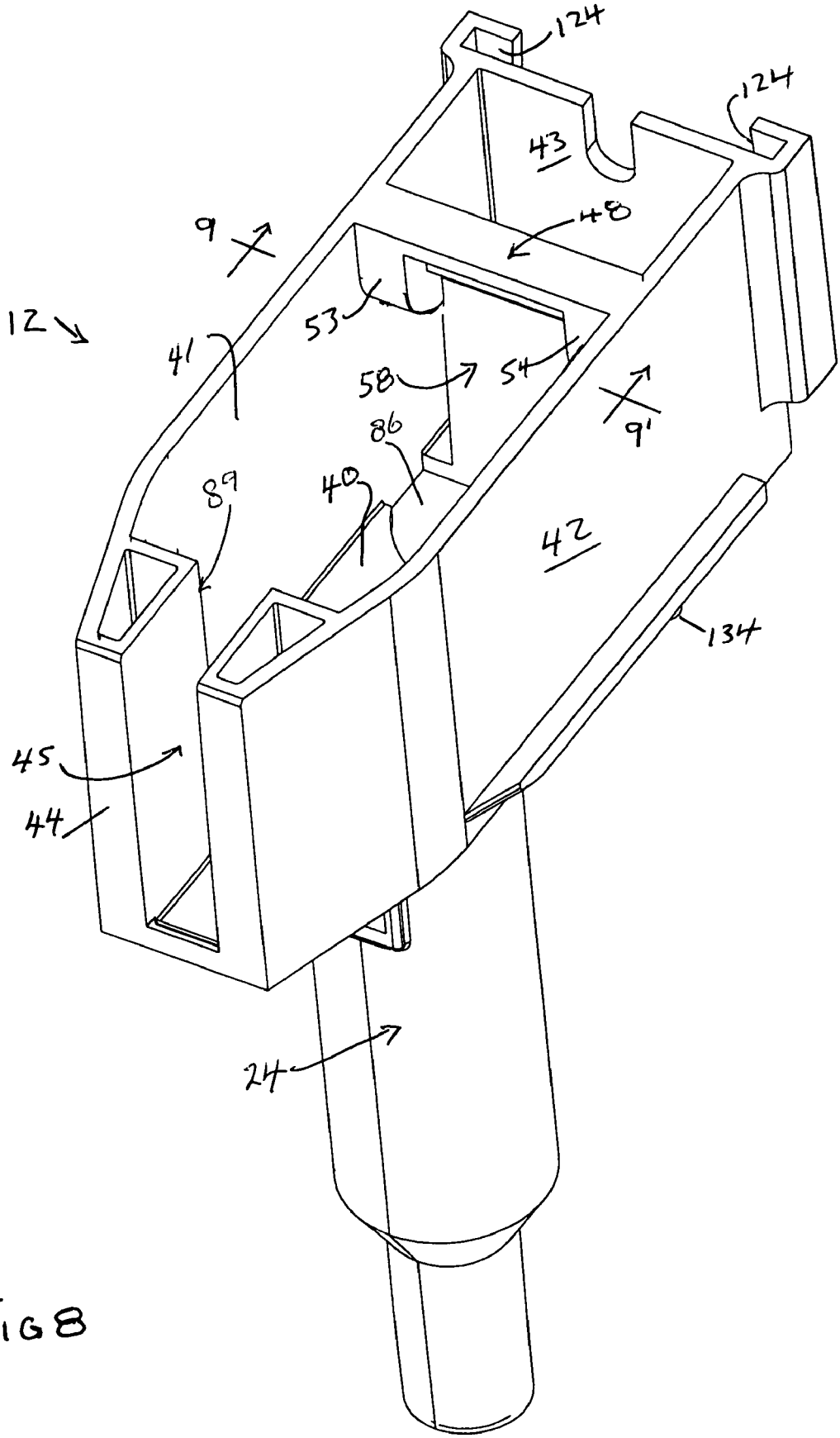
FIG. 8 is a top front perspective view of the housing of FIG. 4.
Figure 9:
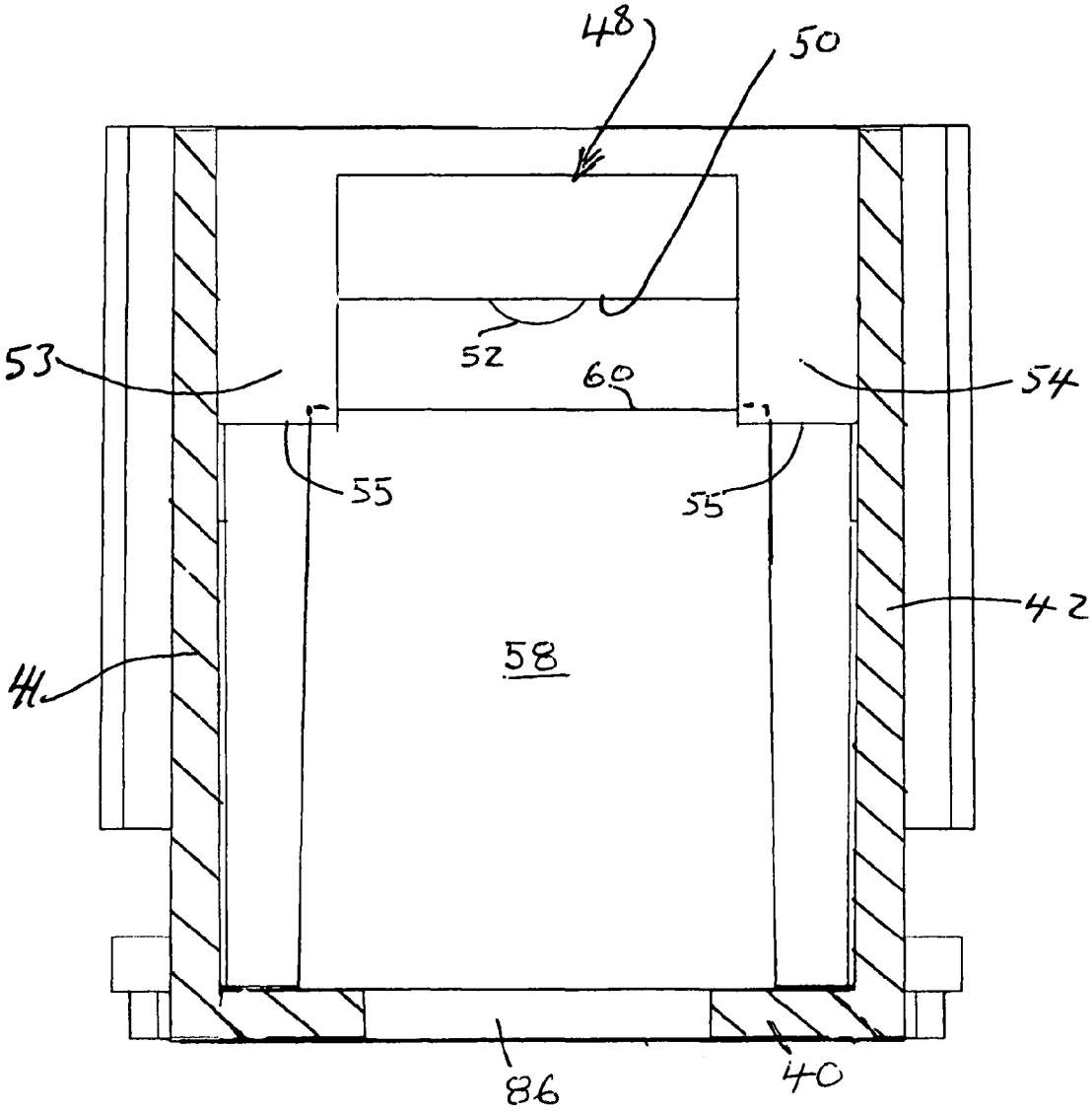
FIG. 9 is a cross-sectional side view along section 9-9' in FIG. 8.

As best seen in FIGS. 8, 9 and 10, the housing includes a base 40, two sidewalls 41 and 42 which extend upwardly and vertically from the base 40 and a rear wall 43 extending vertically upwardly from the base 40 joining the rear ends of the sidewalls 41 and 42.

The piston chamber forming member 24 extends downwardly from the base 40 with the open upper end of the chamber 26 opening upwardly through the base 40. The sidewalls 41 and 42 end forwardly at a front wall 44 with a central front slot 45 extending rearwardly into the interior of the housing 12.

A fulcrum member 48 extends as a bridge between the sidewalls 41 and 42 proximate the upper edges of the sidewalls and presents a downwardly directed fulcrum surface 50. On the inside surfaces of each of the sidewalls 41 and 42, a pair of housing longitudinal locating lug members 53 and 54 extend downwardly. Each of the lug members extends inwardly towards the other lug member partially towards the opposite sidewall. Each lug member has a lowermost end surface 55 spaced a distance above the base 40. As seen the fulcrum member 48 extends between the lug members (53 and 54) with the lug members extending downwardly past the fulcrum surface 50 on either side of the fulcrum member to distal ends of the lug members represented by the lowermost end surface 55.

On the base 40, rearward of the fulcrum member 48, a finger-like stop member 58 extends upwardly from a lower end 59 to a distal end 60. The stop member 58 is resilient and has an inherent bias to move to the stopping position shown in FIG. 10, however, may be deflected by rearwardly directed forces to assume an unstopping position illustrated, for example, in FIG. 12. The stop member 58 is thus movable between the stopping position and the unstopping position and is biased to the stopping position.

Figure 11:
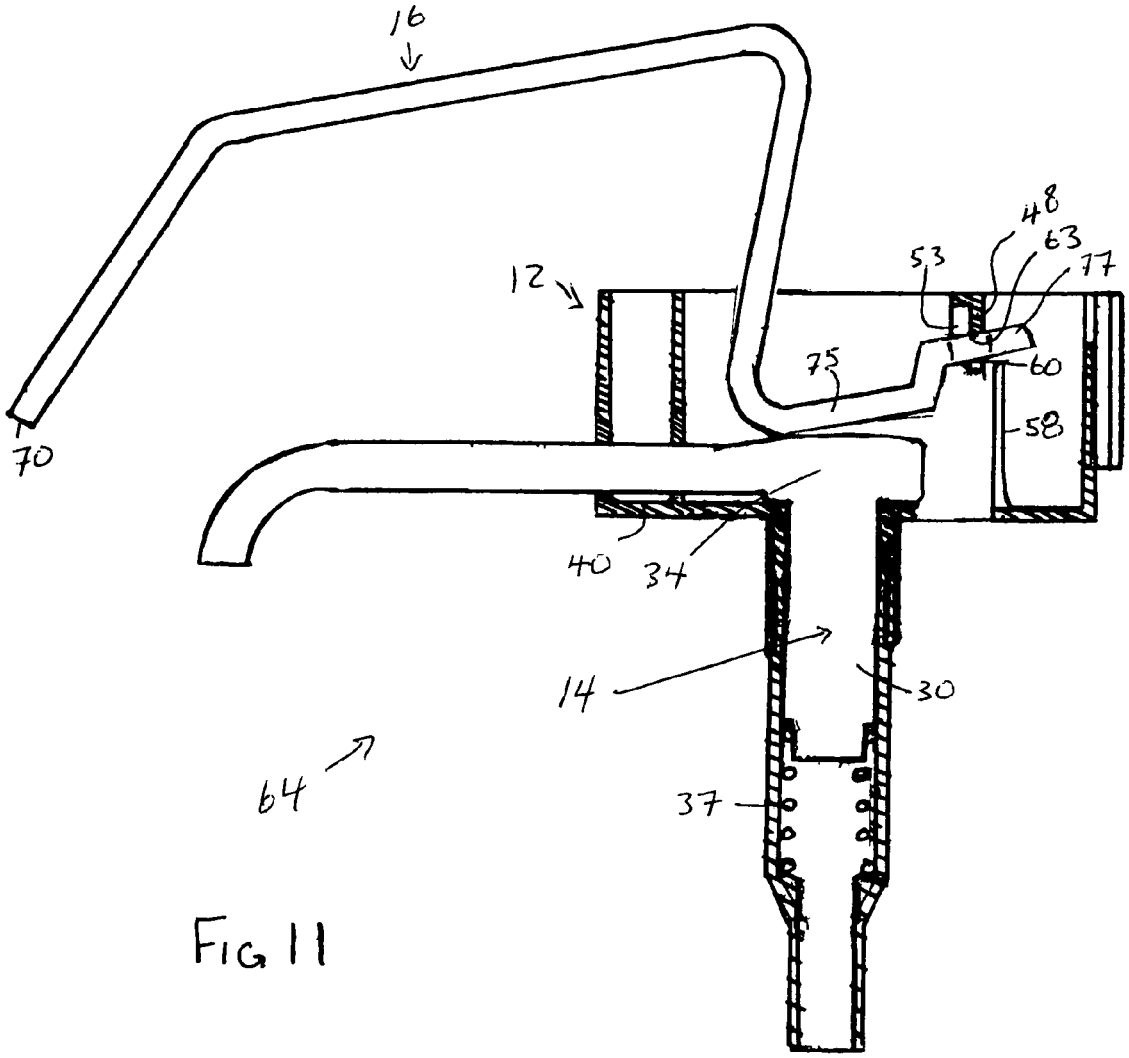
FIG. 11 is a side view the same as FIG. 8 showing the pump mechanism in an operative condition with the piston element in a retracted position.

Referring to the side view shown in FIG. 10, a helical coil spring 37 is received within the chamber 26 and biases the piston element 14 upwardly towards an extended position shown in FIG. 10. The piston element 14 is movable downwardly along the central axis 28 to a retracted position as shown in FIG. 11.

The piston element 14 has an axially upwardly directed lever engaging surface 62. FIGS. 10 and 11 illustrate a pump mechanism 64 comprising an assembly of the housing 12, the piston element 14 and the lever 16 including the spring member 37. Various components of the internal details of the pump which provide for one-way flow through the chamber 26 on reciprocal moving of the piston element 14 within the chamber 26 are not shown for simplicity.

The lever 16 is shown as preferably formed from an elongate flat plate of metal bent and formed to have a desired shape as seen in FIG. 4. The lever has an upper surface 65, a lower surface 66 and two side surfaces 67 and 68. The lever is elongate extending about a central longitudinal 69 therethrough which can be considered to lie in a flat longitudinal plane, not shown.

As seen in FIG. 10, the lever 16 extends along its longitudinal 69 from a front end 70 to a rear end 71. The lever 16 extends diagonally upwardly from the front end 70 as a front portion 72 and rearwardly as a horizontal portion 73 then downwardly as a drop portion 74 then horizontally rearwardly as an engagement portion 75 then upwardly as a rise portion 76 and then horizontally rearwardly as a rear portion 77. As best seen in FIG. 4, the rear portion 77 has a center slot 78 extending longitudinally from the rear end 71.

Two lever longitudinal locating slotways 79 and 80 are provided in the rear portion extending inwardly from each side surface 67 and 68 completely from the upper surface 65 to the lower surface 66. The side slotways 79 and 80 are sized to permit the lug members 53 and 54 to be vertically slidable therein.

As seen in FIGS. 10 and 11 in an operative condition, the lever 16 is located within the housing 12 with the stop member 58 in its stopping position and the lower surface 66 of the lever 16 above the distal end 60 of the stop member 58. The upper surface 65 of the lever is in engagement with the fulcrum surface 50 of the fulcrum member 48. A central locating button 52 extending downwardly from the fulcrum surface 50 centrally between the sidewalls 41 and 42 is received within the longitudinal slotway 78 of the lever 16 to assist in locating the lever with its longitudinal 69 disposed centrally of the housing 12 and parallel to a longitudinal centrally through the housing. The lug members 53 and 54 are engaged within the slotways 79 and 80 of the lever.

The lower surface 66 of the lever 16 over the engagement portion 75 of the lever 16 is engaged with the lever engaging surface 62 of the piston element 14 at an engagement location on the lever 16. As a result of the spring member 37, the piston element 14 biases the lever 16 upwardly. The lever 16 is adapted to pivot about a pivot axis 63. The center axis 28 and the longitudinal 69 of the lever 16 lie in the same flat plane and the pivot axis 63 is normal to this flat plane. The bias of the spring member 37 upwardly attempts to pivot the lever 16 about the pivot axis 63 clockwise which pivoting is prevented with the piston element 16 in an extended position as shown in FIG. 10 by the distal end 60 of the stop member 58 being engaged by the lower surface 66 of the rear portion 77 of the lever 16. From the position of FIG. 10 in use by a user to dispense fluid, the front end 70 of the lever 16 is moved downwardly such that the pump mechanism 64 assumes the configuration of FIG. 11 with the piston element 14 in a retracted position. The lever 16 has pivoted about the pivot axis 63 with the front end 70 of the lever having moved downwardly and the engagement portion 75 of the lever having moved the piston element 14 downwardly into the chamber 26 to the retracted position. The slotways 79 and 80 on the lever 16 have slid downwardly relative to the lug members 53 and 54, however, the lug members 53 and 54 remain located within the slotways 79 and 80. The rear portion 77 of the lever has moved upwardly from the stop member 58.

On release of the front end 70 of the lever 16 by a user, under the bias of the spring member 37, the piston element 14 urges the front end of the lever 16 upwardly pivoting it about the pivot axis 63 so as to return to the configuration of FIG. 10.

Figure 12:
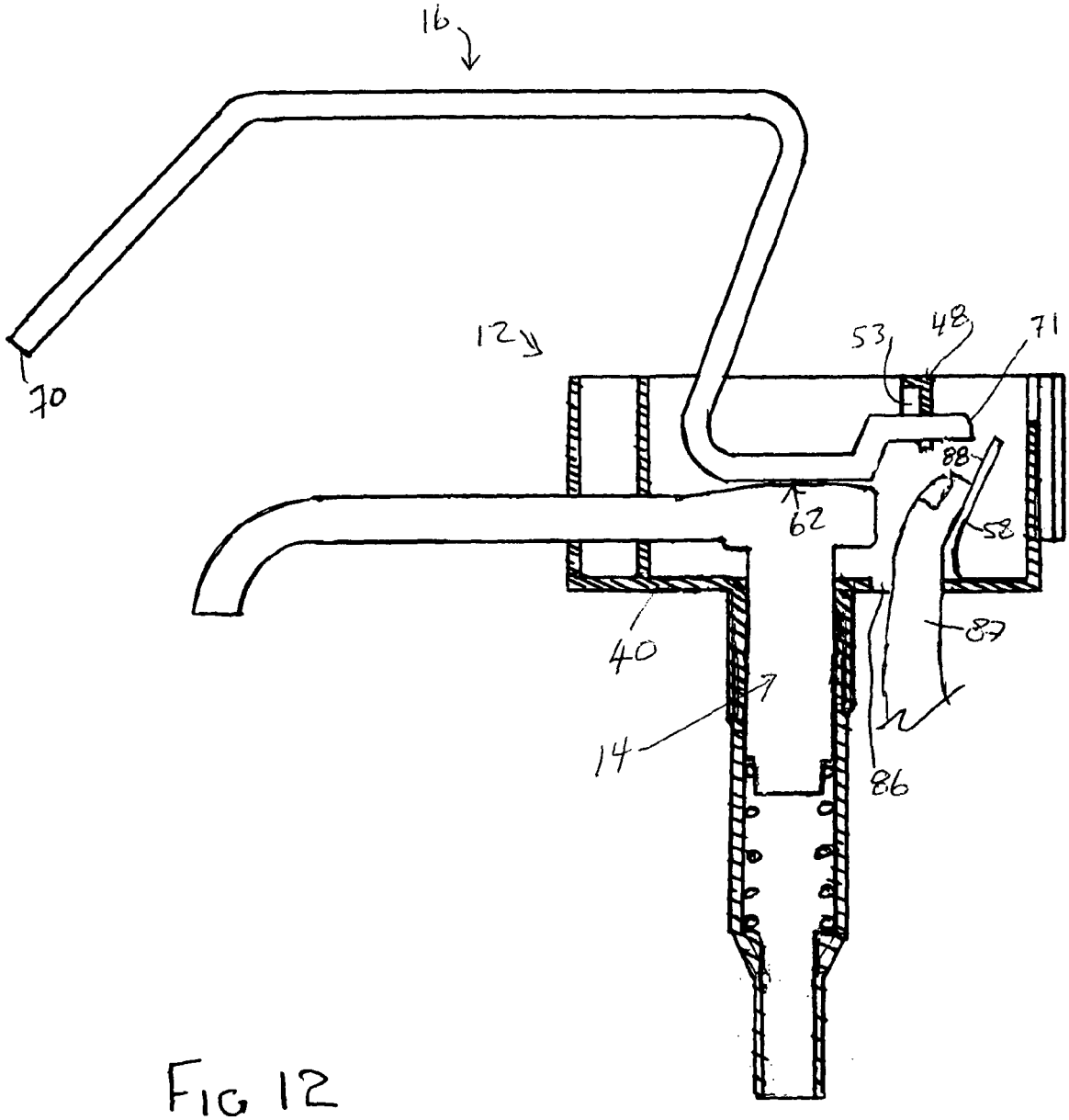
FIG. 12 illustrates a side view the same as that in FIG. 10, however, in a non-operative condition in which the stopping member has been deflected to an unstopping position.
Figure 13:
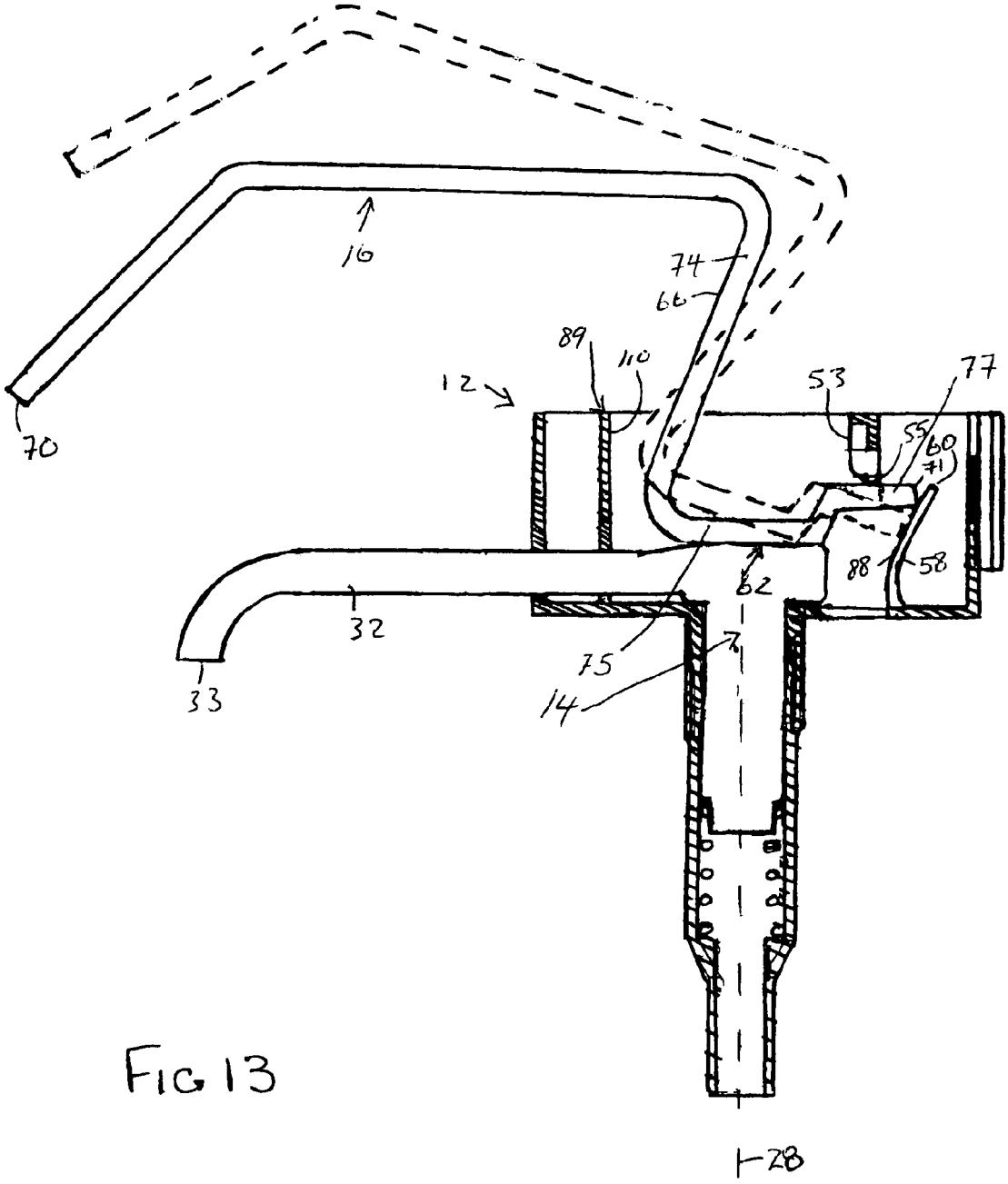
FIG. 13 is a side view the same as that shown in FIG. 12, however, in a non-operative condition in which the lever member has been moved downwardly to a disengaged position in which the lever member is capable of being removed, or inserted.

Reference is now made to FIGS. 12 and 13 which illustrate from the operative condition of FIG. 10, the removal of the lever 12 from the pump mechanism 64.

As seen in FIG. 12, the base 40 has an opening 86 therethrough immediately forward of the stop member 58. A user's finger 87 is shown inserted through the opening 86 into engagement with the forward surface 88 of the stop member 58 and applying forces so as to deflect the stop member 58 to the unstopping position as shown in FIG. 12 with the distal end 60 deflected rearwardly. From the position of FIG. 12, manual forces are applied vertically downwardly onto the lever 16 to move the lever vertically downwardly against the bias of the spring member 37 also moving the piston element 14 vertically downwardly to assume the non-operative configuration shown in FIG. 13. In sliding downwardly from the position of FIG. 12, the lug members 53 and 54 are received in the slotways 79 and 80 and guide the lever 16 downwardly. However, in the position of the lever 16 shown in FIG. 13 in solid lines, the upper surface 65 of the rear portion 77 of the lever 16 is below the lowermost surface 55 of the lug members 53 and 54 such that the lug members 53 and 54 are no longer engaged within the slotways 79 and 80. From the position shown in solid lines in FIG. 13, the piston is capable of being slid horizontally forwardly perpendicular to the central axis 28 until the lower surface 66 on the drop portion 74 of the lever 16 may engage the rearwardly directed inner surface 110 of an interior front wall 89. As well, the lever 16 is free to be pivoted clockwise as, for example, to assume the angled position illustrated in dashed lines in FIG. 13 in which lever 16 has effectively been pivoted about a pivot point between the engagement portion 75 of the lever and the lever engaging surface 62 on the piston element 14. In the angled position shown in dashed lines in FIG. 13, the lever 16 has its rear portion 77 below the lug members 53 and 54 with the lug members not engaged within the slotways 79 and 80. From the angled position shown in dashed lines in FIG. 13, the piston may be slid forwardly until its rear end 71 is forward of the lug members 53 and 54 and the fulcrum member 48 and the lever 16 may thus be readily removed upwardly from the housing 12.

It is to be appreciated that a combination of forward sliding of the lever 16 along its longitudinal 69 and relative pivoting of the lever 16 clockwise together with applying manual forces directed downwardly in opposition to the upwardly directed forces from the spring member 37 applied through the piston element 14 will permit manipulation of the lever 16 relative to the remainder of the pump mechanism 64 for removal. In removal, there is a requirement of movement of the stop member 58 from its stopping position to its unstopping position shown in FIG. 12 and then subsequent relative downward movement of the lever member such that the slotways 78 and 79 are out of engagement with the lug members 53 and 54 whereupon the lever member is then free to be moved longitudinally, that is, forwardly relative to the housing 12, with or without pivoting for removal. The lever 16 may be removed without pivoting merely by longitudinal movement from the position shown in FIG. 13 forwardly provided there is sufficient distance that the interior front wall 89 is not engaged prior to the rear end 71 of the lever 16 becoming disposed in front of the lug members 53 and 54 and the fulcrum member 48.

Insertion of the lever 16 into the pump mechanism 64 is provided by reversing the steps for removal, however, without the need for moving the stopping member 58 to the unstopped position with a user's finger. Rather, in manipulating the lever 16 to move rearwardly with the upper surfaces 65 of the lever disposed below the lug members 53 and 54, the rearward movement of the lever along the longitudinal will place the rear end 71 of the lever into engagement with the forward surface 88 of the stop member 58 and manual pressures applied to the lever 16 can deflect the stop member 58 to its unstopping position so as to assume a position as, for example, shown in solid lines in FIG. 13 in which the slotways 79 and 80 are disposed vertically below and in alignment with the lug members 53 and 54. Subsequently, by upward movement of the lever 16, the lug members 53 and 54 become engaged in the slotways 79 and 80 and remain in sliding engagement guiding the lever 16 to slide upwardly. The lever 16 initially slides upwardly with the stopping member 58 having its forward surface 88 biased into the rear end 71 of the lever. However, once the rear end 71 of the lever is raised to a height above the distal end 60 of the stop member 58, the stop member 58 will return to its stopping position disposed underneath the lower surface 66 of the lever.

Figure 14:
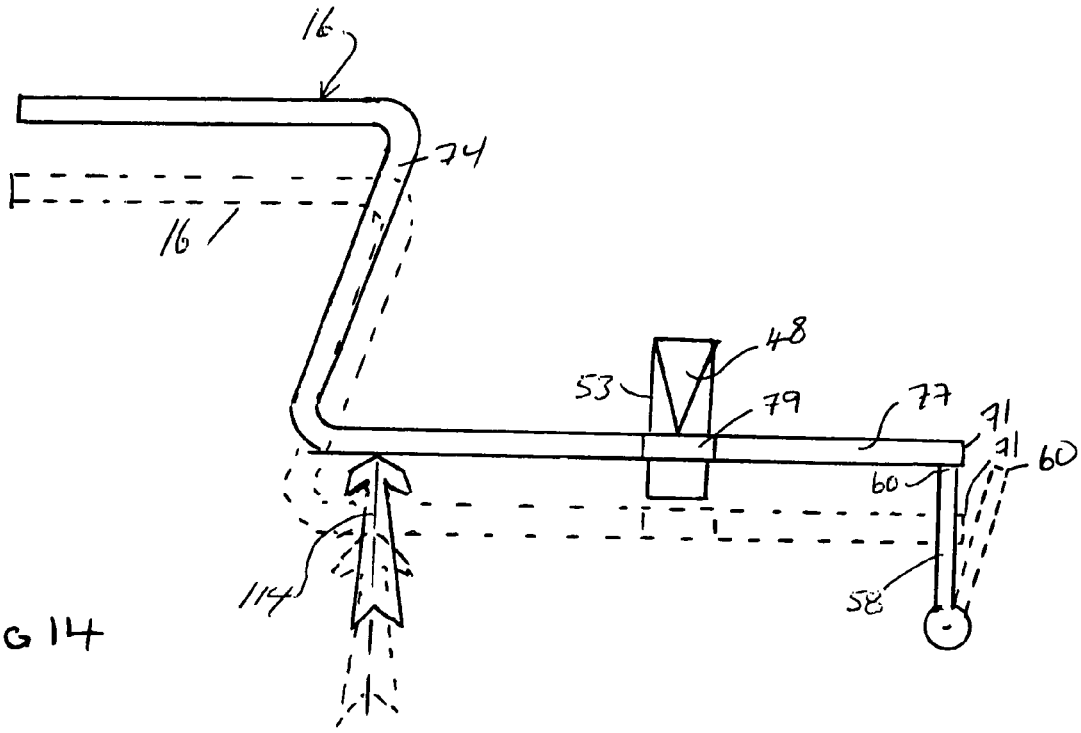
FIG. 14 is a schematic side view showing operation of a lever assembly in accordance with a second embodiment of the invention.

Reference is made to FIG. 14 which shows a schematic side view illustrating the second embodiment of the lever member 16 and a number of components from the housing 12. The housing components shown are alternate embodiments of the fulcrum member 48, stop member 58 and lug members 53 which are fixed in location relative to each other. The lever 16 is marked to show the location of the slotway 79. The piston element 14 is schematically shown as arrow 114. FIG. 14 shows in solid lines, an operative condition assuming a piston element, not shown, is in a fully extended position and the stop member 58 is in a stopping position. FIG. 14 shows in dashed lines, an inoperative condition in which the stopping member 58 is moved to an unstopping position and the lever 16 is shown as having been slid vertically downwardly to clear the lug member 53 such that the lever is free for removal as by sliding longitudinally forwardly and/or pivoting.

Figure 15:
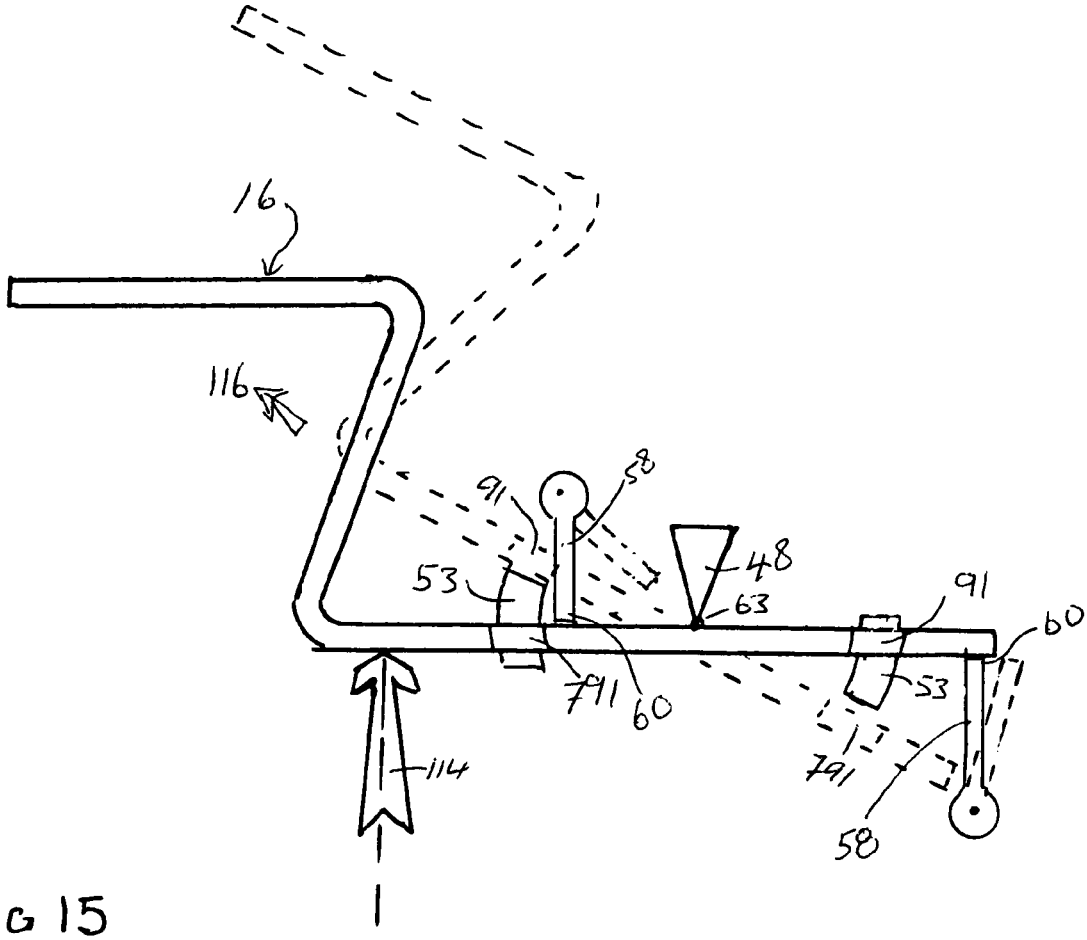
FIG. 15 is a schematic side view showing operation of a lever assembly in accordance with a third embodiment of the invention.

Reference is made to FIG. 15 illustrating another schematic side view as in FIG. 14, however, showing a third embodiment in which two arcuate lug members 53 are provided fixed on the housing, one forward of the fulcrum 48 and a second rearward of the fulcrum, however, only one is necessary. Similarly, two arcuate slotways 91 are provided in the side surfaces of the lever 16. Two stop members 58 are shown, one forward of the fulcrum and one rear of the fulcrum, however, only one is necessary. The arcuate lug members 53 and the corresponding arcuate slotways 91 have arcuate engagement surfaces forming segments of an arc disposed about the pivot axis 63. The lever 16 is shown in solid lines in an operative condition with both the stop members 58 in the stopping position in solid lines. In this operative condition, the lever 16 is pivotable about the fulcrum axis 63 with the arcuate lug members 53 slidable within the arcuate slotways 79 counterclockwise from the extended position shown in solid lines against the bias of the piston element arrow 114. Shown in dashed lines is an inoperative condition in which each stop member 58 has been moved to an unstopped position and the lever 16 has been rotated clockwise about the fulcrum axis 63 to a position in which the slotways 79 clear the lug members 53 and the lever may be withdrawn by sliding radially along its longitudinal in a direction indicated by the arrow 116 and/or with further clockwise pivoting.

The preferred embodiments illustrate stop members 58 which comprise a finger-like member whose distal end can be moved preferably by deflection. It is to be appreciated that many other forms of stop members may be provided. The stop member is preferably provided to be resiliently biased to assume the stopping position but this is not necessary. The stopping member may be movable between the stopping position and unstopped position as by pivoting or sliding and have some mechanism such as a catch or the like to retain the stopping member in the stopping position until unlatched.

As a mechanism for moving the stopping member 58 from the unstopped position to the stopping position, the preferred embodiment shows the use of a user's finger in FIG. 13 which extends upwardly from the bottom of the housing 12. Various other access openings and tools, rather than a user's finger, could be inserted as, for example, from the top or side of the housing 12.

An actuator member (not shown) carried on the housing 12 could be provided as for manual movement of the actuator to move the stop member between the unstopped position and the stopping position and possibly retain the stop member in either of these positions.

Replacement of the lever 16 is believed to be preferable as, for example, to provide handle members which have different configurations so as to provide for different stroke of the piston in moving between the extended and the retracted position. Thus, for example, the lever 16 in FIG. 10 could be replaced by a lever 16 as in FIG. 14 which having a modified configuration as shown in FIG. 14 without the rise portion 76 such that the rear portion 77 extends horizontally forwardly to the drop portion 74. Such a handle would provide for a different stroke of the piston, that is, by providing for the piston element 14 to assume an extended position which is withdrawn from the chamber 26 by a greater distance and, thus, would provide for an increased stroke in moving to the same retracted position. Additionally, different levers may be required so as, for example, to provide for different usages as by handicapped persons and the like or by a person's hand as contrasted with a person's arm. Different handles may be desired so as to identify by coding of the handles by shape or colour to different fluid within the dispenser or to identify by appearance of the handle, the nature of the relative stroke and therefore the volume to be dispensed as associated with that lever.

Reference is made to FIGS. 4 to 7 which show that the housing 12 is adapted to be engaged to the back plate 20 by sliding rearwardly over a narrow portion 120 of the back plate then slid downwardly to receive ears 122 on the back plate 20 in a lateral slot 124 on each side of the back wall 43 of the housing. The cover 18 is engaged on the housing 12 by sliding longitudinally rearwardly onto the housing 12 with a top wall 126 and sidewalls 128 of the cover overlying the top and sidewalls of the housing 12 and a partial bottom wall 130 of the cover 18 carrying catch recesses 132 which slide relative to and engage on a catch member 134 carried on the outside of sidewalls 41 and 42 of the housing extending laterally outwardly. The cover 18 also carries rear catch members 138 adapted to engage resilient catch members 140 carried on the back plate 20. The resilient catch member 140 can be manually deflected laterally inwardly for release from engagement with the cover rear catch members 138 and thus release the cover 18 for forward longitudinal sliding and removal.

The cover has two catch recesses 132 into which the catch 134 may be received. The cover 18 may initially be secured to the housing 12 with the rearmost catch recess 132 engaged on the catch member 134 and, in this position, the housing 12 may be coupled to the back plate 20. After the housing 12 has been coupled to the back plate 20, the cover 18 may then be slid rearwardly on the housing 12 to engage the forward catch recess 132 on the catch member 134 and to engage the cover latch member 138 with the catch members 140 on back plate 20, preventing forward sliding of the cover 18 relative the back plate 20 and housing 12 and preventing the housing 12 from being slid upwardly relative the back plate 20.

An opening 142 in the upper surface 126 of the cover 18 is sized to align above the interior of the housing 12 and provide an adequate passageway for movement of the lever 16 between the extended and retracted positions and, as well, for insertion of the lever for coupling and uncoupling of the lever to the remainder of the pump mechanism. The bottle 22 sits on shelf arms 144 carried on the back plate with the open end of the bottle received about the piston chamber forming member.

While the invention has been described with reference to preferred embodiments, many modifications and variations will now occur to a person skilled in the art. For a definition of the invention, reference is made to following claims.

The invention claimed is:

1. A removable lever assembly comprising:

a housing having a lever actuator element received thereon for reciprocal movement along a central axis between an extended position and a retracted position, the element having an axially directed lever engaging surface, a spring member biasing the element axially outwardly to the extended position, a lever fulcrum member fixedly secured to the housing spaced from the engaging surface in a rearward direction which extends radially relative to the central axis, a stop member mounted on the housing, the stop member movable between a stopping position and an unstopping position, an elongate lever extending about a longitudinal from a rear end to a front end, a housing longitudinal locating member on the housing and a complementary lever longitudinal locating member on the lever member for inter-engagement to limit movement of the lever member relative the housing longitudinally along the longitudinal of the lever member, the longitudinal lever locating member being removable from engagement with the housing longitudinal locating member by relative movement of the lever member relative to the housing generally in the direction of the central axis, wherein in an operative condition with: (a) the lever member located relative the housing to extend about its longitudinal in the rearward direction with the rear end rearward of the lever engaging surface and the front end forward of the lever engaging surface, (b) the lever engaging surface in engagement with the lever member intermediate the rear end and the front end of the lever member and forward of the fulcrum member biasing with the lever engaging surface the lever member into the fulcrum member to pivot the lever member about the fulcrum member in a first rotational direction about a fulcrum axis which is normal to the rearward direction, normal to the central axis and normal to the longitudinal of the lever member; (c) the housing longitudinal locating member in engagement with the lever longitudinal locating member, and (d) the stop member in the stopping position, then: the lever member is limited in pivoting about the fulcrum axis between; (i) a first position in which rotation in the first rotational direction is limited by the stop member and the element is in the extended position, and (ii) a second position in which rotation in a second rotational direction opposite to the first rotational direction is limited to an inner position in which the element is in the retracted position, wherein from the operative condition with the stop member being maintained mounted on the housing on the stop member being moved to the unstopped position, the lever member is movable relative the housing to move the lever longitudinal locating member generally in a direction of the central axis relative the housing longitudinal locating member to a clear position in which the housing longitudinal locating member and the lever longitudinal locating member are no longer in engagement and the lever member is slidable longitudinally forwardly relative the housing for removal from the housing.

2. A removable lever assembly as claimed in claim 1 wherein the longitudinal of the lever member and the central axis lie in a common flat plane.

3. A removable lever assembly as claimed in claim 1 wherein the stop member is carried on the housing rearward of the fulcrum member.

4. A removable lever assembly as claimed in claim 3 wherein from the operative condition with the stop member being maintained mounted on the housing if the stop member is moved to the unstopped position, to move the lever member to the clear position, the lever member is moved relative the housing in the direction of the central axis away from the fulcnun member by generally linear motion or is pivoted about the fulcrum axis in the first rotational direction past the first position.

5. A removable lever assembly as claimed in claim 1 wherein the stop member is carried on the housing forward of the fulcrum member.

6. A removable lever assembly as claimed in claim 5 wherein from the operative condition with the stop member being maintained mounted on the housing if the stop member is moved to the unstopped position, to move the lever member to the clear position, the lever member is moved relative the housing in the direction of the central axis away from the element by generally linear motion or pivoted about the fulcrum axis in the second rotational direction past the inner position.

7. A removable lever assembly as claimed in claim 1 wherein the housing having a piston chamber forming member fixed thereto, the piston chamber forming member defining a cylindrical chamber about the central axis, the chamber having an open outer end, the lever actuating element comprising a piston forming element coaxially slidably received in the chamber for reciprocal sliding therein between the extended position and the retracted position to dispense fluid, the piston forming element having an inner portion within the chamber and an outer portion extending out of the open outer end of the chamber and presenting the axially directed lever engaging surface, the spring member biasing the piston forming element axially outwardly to the extended position.

8. A removable lever assembly as claimed in claim 7 wherein the housing having a base member with the piston chamber forming member extending downwardly therefrom, the housing including a pair of longitudinally extending sidewalls upstanding from the base member spaced on either side of the piston chamber forming member, the lever member extending through the housing above the piston chamber forming member between the inner surfaces of the sidewalls.

9. A removable lever assembly as claimed in claim 8 wherein the lever member has an upper surface, a bottom surface, and two side surfaces, the upper surface and bottom surface being substantially parallel, and the two side surfaces being substantially parallel to the longitudinal.

10. A removable lever assembly as claimed in claim 9 wherein the lever member is formed from an elongate flat plate of metal and is bent to have a desired shape.

11. A removable lever assembly as claimed in claim 8 wherein the fulcrum member extends between the two side walls presenting a fulcrum surface directed downwardly for engagement with an upper surface of the lever member, the fulcrum axis extending normal to the side walls between the side walls.

12. A removable lever assembly as claimed in claim 11 wherein the lever member has a bottom surface and two side surfaces, the lever longitudinal locating member comprising a pair of slotways extending inwardly from each side surface of the lever member completely from the upper surface to the bottom surface, the housing longitudinal locating member comprises a pair of lug members on the sidewalls extending inwardly partially toward the other sidewall, the lug members sized to permit relative sliding of the lever member relative the housing with the lug members within the slotways.

13. A removable lever assembly as claimed in claim 11 wherein the pair of lug members extend from the fulcrum member generally parallel to the central axis, the lug members permitting relative sliding of the lever member generally relative the housing parallel to the central axis with the lug members within the slotways.

14. A removable lever assembly as claimed in claim 8 wherein the housing includes:

an opening between the sidewalls through which the lever member extends to present the front end of the lever member for manual engagement by a user, and through which opening the rear end of the lever member is inserted for removal and attachment.

15. A removable lever assembly as claimed in claim 8 wherein the upper portion of the piston forming element and its lever engaging surface are disposed between the sidewalls, an elongate hollow discharge nozzle is carried by the piston forming element extending forwardly from the outer portion of the piston forming element and forwardly from the housing between the sidewalls to a discharge outlet forward of the housing.

16. A removable lever assembly as claimed in claim 1 wherein the stop member is resiliently biased to the stopping position and movable against the bias between the stopping position and the unstopping position.

17. A removable lever assembly as claimed in claim 1 wherein the stop member has a first end fixedly coupled to the housing against removal and the stop member extending away from the first end to a distal second end, the stop member extending from the first end toward the second end generally parallel the central axis, the stop member being resilient along its length from first end to the second end and biased to assume the stopping position, the stop member is deflected against its bias to assume the unstopping position, wherein in the operative position with the stop member in the stopping position the lever member is limited in pivoting about the fulcrum axis at the first position by engagement of the lever with the second end of the stop member.

18. A removable lever assembly as claimed in claim 17 wherein in the operative position with the stop member in the stopping position the stop member is accessible by a user to manually deflect the stop member to the unstopping position.

19. A removable lever assembly as claimed in claim 1 wherein the lever member has a first surface, a second surface, and two side surfaces one on each side of the longitudinal of the lower member, the lever longitudinal locating member comprising a pair of slotways extending inwardly from each side surface of the lever member completely from the first surface to the second surface, the fulcrum member presenting a fulcrum surface directed for engagement with the first surface of the lever member between the slotways, the housing longitudinal locating member comprises a pair of lug members on the housing, the fulcrum member extending between the lug members with the lug members extending past the fulcrum surface on either side of the fulcrum member to a distal end of each lug member, each lug member located in a respective one of the slotways when the housing longitudinal locating member is in engagement with the lever longitudinal locating member, with the stop member in the stopping position the lever member is prevented from movement toward the distal end of the lug member sufficiently to clear the distal end of the lug member from engagement with the slotways, with the stop member in the unstopping position the lever member is movable relative the lug members sufficiently that the first surface of the lever member is past the distal end of the lug members to clear the lug members from engagement with the slotways and permit longitudinal sliding of the lever member forwardly relative the housing for removal of the lever member from the housing.

20. A removable lever assembly as claimed in claim 19 wherein the pair of lug members extend from the fulcrum member generally parallel to the central axis, the lug members permitting relative sliding of the lever member generally relative the housing parallel to the central axis with the lug members within the slotways.

* * * * *